US005706360A

United States Patent [19]

Khandekar

[11] Patent Number: 5,706,360

[45] Date of Patent: Jan. 6, 1998

[54] HEADSET WITH SPECTACLE TEMPLE ACCOMMODATING OPENINGS

[76] Inventor: Pramod Khandekar, 1624 Raspberry Ct., Edison, N.J. 08817

[21] Appl. No.: 562,735

[22] Filed: Nov. 27, 1995

[51] Int. Cl.[6] ..... H04R 25/00

[52] U.S. Cl. ..... 381/183; 381/187; 351/123; 351/156

[58] Field of Search ..... 381/183, 187, 381/68.5, 25; 379/430; 181/128, 129, 130, 135, 136; 2/209, 403; 351/123, 158

[56] References Cited

U.S. PATENT DOCUMENTS

| | | | |
|---|---|---|---|
| 2,647,956 | 6/1953 | Newman et al. | 381/169 |
| 4,548,484 | 10/1985 | Ehring | 351/123 |
| 4,670,911 | 6/1987 | Dunford . | |
| 4,730,916 | 3/1988 | Liautaud et al. | 381/156 |
| 4,856,089 | 8/1989 | Horton . | |
| 4,882,769 | 11/1989 | Gallimore | 455/351 |
| 4,901,355 | 2/1990 | Moore . | |
| 5,009,496 | 4/1991 | Holtan et al. | 351/123 |
| 5,029,216 | 7/1991 | Jhabvala et al. | 381/68 |
| 5,068,923 | 12/1991 | Sjoqvist . | |
| 5,138,722 | 8/1992 | Urella et al. . | |
| 5,164,987 | 11/1992 | Raven | 381/183 |
| 5,201,856 | 4/1993 | Edwards | 2/209 |
| 5,268,710 | 12/1993 | Austey | 351/121 |
| 5,335,285 | 8/1994 | Gluz | 381/187 |
| 5,367,345 | 11/1994 | Da Silva | 351/123 |
| 5,511,251 | 4/1996 | Brakas | 351/123 |
| 5,579,400 | 11/1996 | Ballein | 381/183 |

FOREIGN PATENT DOCUMENTS

| | | | |
|---|---|---|---|
| 0128598 | 8/1991 | Japan | 381/183 |

*Primary Examiner*—Curtis Kuntz
*Assistant Examiner*—Rexford N. Barnie
*Attorney, Agent, or Firm*—Plevy & Associates

[57] ABSTRACT

A headset device adapted to he utilized with spectacles having temples. The headset includes a first ear cup and a second ear cup. Each ear cup is adapted to enclose an ear of a user. Each ear cup also has a temple accommodating mechanism adapted for receiving one of the temples. The headset further includes a head strap for coupling the ear cups together. The head strap further providing a bias that maintains each ear cup positioned over the ear of the user.

16 Claims, 4 Drawing Sheets

HEADSET WITH SPECTACLE TEMPLE ACCOMMODATING OPENINGS

BACKGROUND OF THE INVENTION

1. Field of the Invention

The present invention relates generally to headsets. More particularly, the present invention relates to a headset device that has openings for accommodating spectacle temples, which allow the audio headset and spectacles to be readily and more comfortably utilized together.

2. Description of the Prior Art

Audio and non-audio headsets are well known in the art. Such devices are used by pilots, communications personnel, music lovers, airport lineman or anyone with a need to hear more than one audio source simultaneously and/or in regulated quantities or sound levels. Headsets typically include a pair of ear cups adapted to enclose the ears of a user for isolating the user's ear from the external environment. The ear cups very often are lined with soft insulating material, which provides cushioning for the user and also sound proofing. The ear cups are typically attached together by a biasing head band, which biases the ear cups against the ears of the user. Such headsets are disclosed by U.S. Pat. No. 5,068,923 to Sjoqvist, entitled NOISE ATTENUATOR ATTACHMENT ARM, issued on Dec. 3, 1991 and U.S. Pat. No. 5,138,722 to Urella et al., entitled HEADSET EAR SEAL, issued on Aug. 18, 1992.

The above prior art headsets generally function satisfactorily, however, such headsets are not adapted for being placed on the head of a user who wears spectacles. More specifically, when the headsets are placed on the head of user wearing spectacles, there is no space between the ear cups of the headset and the face of the user for accommodating the spectacle sidebars. Thus, the user must forcibly slide the spectacle temples over the ear, underneath the ear cups. Such a configuration reduces the effectiveness of the headset because the temples push and space the ear cups away from the user's ear, when slid underneath the ear cups. Further, in response to the ear cups being pushed outward, the biasing affect of the head strap places a concentrated load on the temples and ear cups. The concentrated load has the negative affect of deforming both the temples and ear cups, which causes these parts to excessively wear. Further, the concentrated load causes the temples to dig into the user's face, which is uncomfortable.

The problem of utilizing spectacles with headsets has been addressed to some extent by U.S. Pat. No. 4,670,911 to Dunford, entitled ATTACHABLE EAR COVERING FOR SPORT ACTIVITIES, issued on Jun. 9, 1987, U.S. Pat. No. 4,856,089 to Horton, entitled COMBINED EYE COVERING AND EAR COVERING ASSEMBLY, issued on Aug. 8, 1989 and U.S. Pat. No. 4,901,355 to Moore, entitled COMBINATION MULTIPLE SUPPORTED VARIABLE POSITION AUDIO INTAKE CONTROL DEVICES, issued on Feb. 13, 1990. Dunford and Horton both disclose an apparatus which combines a modified spectacle set with a headset adapted to receive the modified spectacles. Neither one of the Dunford or Horton headsets are capable of receiving a conventional spectacle set. Moore on the other hand discloses a pair of spectacles that includes a pair of miniature speakers that are releasably connected to the sidebars of the spectacles. The speakers however, are not useable alone without the spectacle, since the speakers are not attached together. Further, the speakers are not configured to fully enclose the ears of the user.

It is, therefore, an object of the present invention to provide a headset device that fully isolates the ears of the user and also is readily utilized in conjunction with a conventional pair of spectacles.

SUMMARY OF THE INVENTION

A headset device adapted to be worn by a user wearing spectacles having a pair of temples. The headset includes a first ear cup and a second ear cup. Each ear cup is capable of enclosing an ear of a user. Each ear cup further includes a temple accommodating means adapted for receiving one of the temples. The temple accommodating means is embodied either by a notch or an aperture. The headset further includes a head strap coupling the ear cups together, which provides a bias that maintains each said ear cup positioned over the ear of the user.

BRIEF DESCRIPTION OF THE DRAWING

The above objects and further features and advantages of the invention are described in detail below in conjunction with the drawings, of which.

DETAILED DESCRIPTION OF THE DRAWINGS

Figure 1:
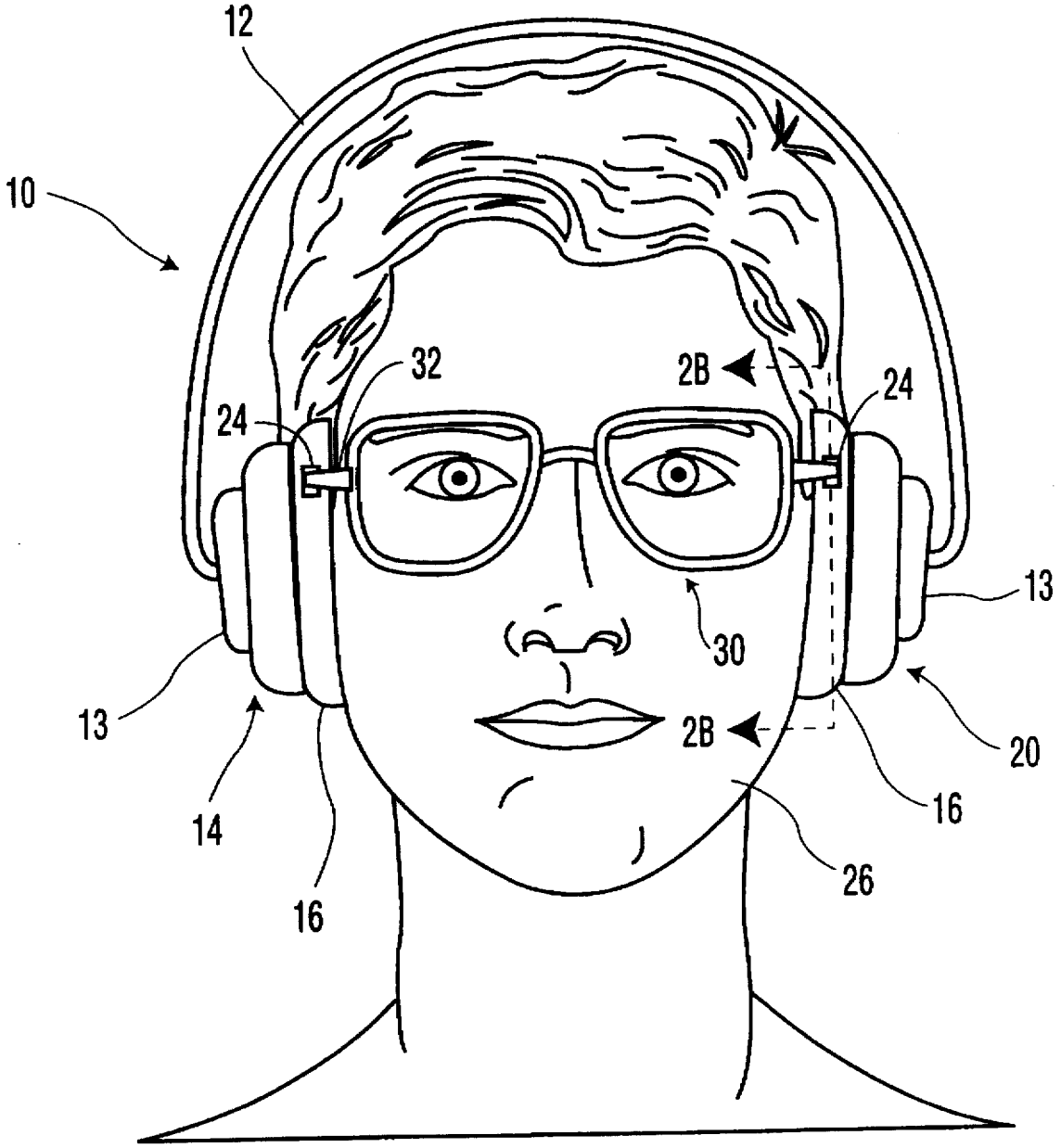
FIG. 1 is a front view of one embodiment of the headset with spectacle temple accommodating openings secured to the head of a user.

Referring to FIG. 1, there is shown an embodiment of the headset 10 of the present invention. The headset 10 is shown secured on a head of a user 26 wearing spectacles 30. As can be seen the present invention enables the user to readily and more comfortably use the headset device with a conventional pair of spectacles 30.

The headset 10 includes a first, right ear cup 14 and a second, left ear cup 20. The ear cups 14,20 are identically configured to completely enclose the ears of the user 26 as shown, thereby isolating a user's ears from the external environment. The headset of the present invention is capable of being configured as an audio headset to provide sound or as a non-audio headset to block sound. When the present invention is configured to provide sound, a speaker 11, shown in phantom in FIG. 2A and the associated electrical coupling is contained within each of the ear cups 14,20. Such a configuration is well known in the art.

The ear cups 14,20 preferably are fabricated from a semi-rigid synthetic material such as plastic, vinyl or fiberglass. A semi-rigid material ensures that the ear cups 14,20 will be durable.

The ear cups 14,20 are attached together by a head strap 12. The head strap 12 provides a bias to maintain the ear cups 14,20 in a position securely over the ears of the user 26, wherein the ears of the user 26 are completely enclosed by the ear cups 14,20. The head strap 12 has a pair of mounting members 13 one of the mounting members 13 is attached to a first end of the head strap 12 and the other mounting member 13 attached to a second end of the head strap 12.

The mounting members 13 are each secured to an outer surface 19 of the ear cups 14 and 20 providing a secure attachment between the ear cups 14,20 and head strap 12.

The head strap 12 preferably is fabricated from an elastically rigid material such as a light weight metal or plastic. A head strap 12 fabricated from an elastically rigid material provides the necessary bias to maintain the ear cups 14,20 positioned over the ears of the user 26.

The ear cups 14,20 each further include a respective padded insert 16 attached to an inner surface of the ear cups 14,20 facing the user's ears. The padded inserts 16 in this embodiment surround the ear of the user 26. By surrounding the ear, the padded inserts 16 provide more comfort to the user 26. The padded inserts 16 also are capable of blocking sound, if fabricated from a sound insulating material, such as environmental noise. The sound blocking quality of the padded inserts 16 enables the headset 10 to be utilized as a protective headset.

Extending through each of the padded inserts 16 is a spectacle temple accommodating opening 24. The openings 24 are adapted to receive a pair of temples 32 of a conventional set of spectacles 30, which enables the ear cups 14,20 to remain positioned on the user's head 26 as shown.

Figure 2A:
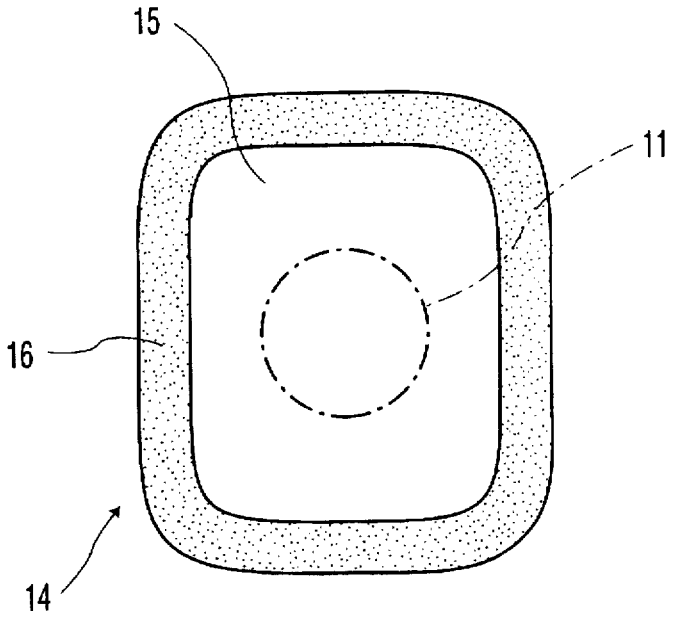
FIG. 2A is an inner view of one of the ear cups shown in FIG. 1.

Referring to FIG. 2A, an inner view of the right ear cup 14 is shown. The ear cup 14 has a concave inner surface 15, which conforms to the ear of the user. This view also shows that the padded insert 16 extends peripherally around the ear cup 14. The padded insert 16 is preferably attached to the ear cup 14 by an adhesive. However, any other suitable attaching method known in the art can be used.

Figure 2B:
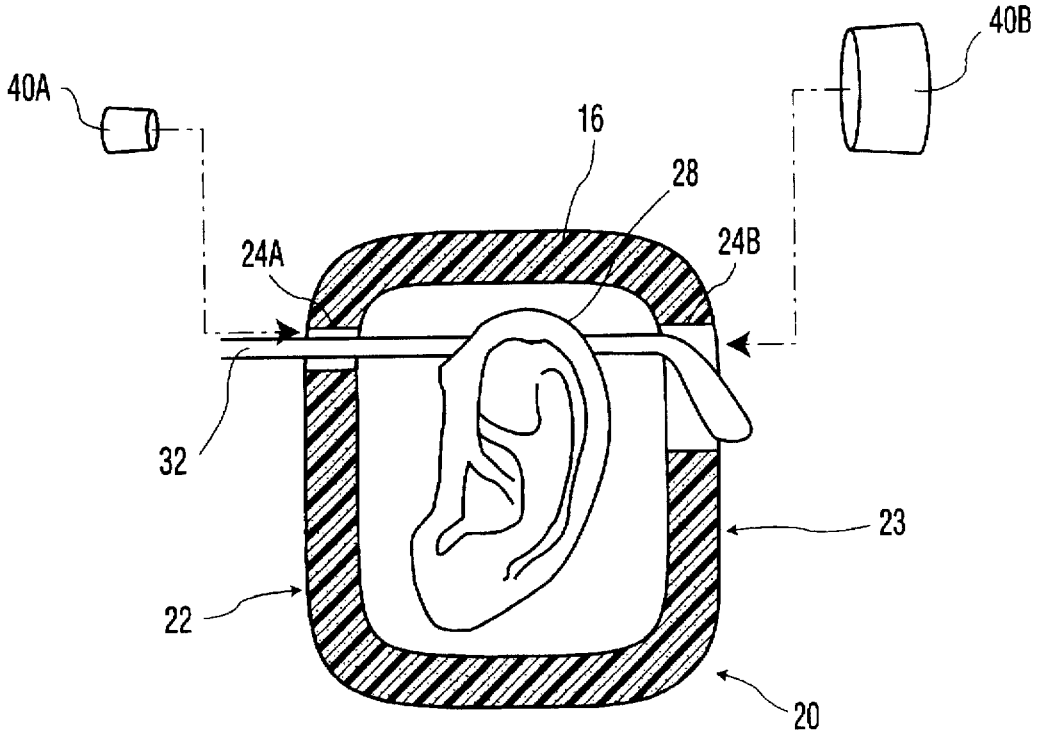
FIG. 2B is a cross-sectional view of one of the ear cups of FIG. 1 along line 2B.

Referring to FIG. 2B, there is shown a cross sectional view through the ear cup 20. As can be seen the spectacle temple accommodating opening 24 includes a first aperture 24A extending through a front facing portion 22 of the padded insert 16 and a second aperture 24B extending through a rear facing portion 23 of the padded insert 16. Both the first aperture 24A and the second aperture 24B extend through the padded insert 16 in a substantially horizontal orientation, which allows the apertures 24A,24B to receive the temple 32. The second aperture 24B is made substantially larger than the first aperture 24A, in order to receive the curved end portion of the temple 32. Additionally, both apertures 24A,24B are positioned within the padded insert 16 as shown so that the temple 32 can be readily inserted into both apertures 24A,24B and positioned behind the ear 28.

It should be understood that notches can be used alternatively in place of the apertures 24A,24B shown and described above. An additional feature of the present invention includes a pair of sound blocking plugs 40A,40B. The sound blocking plugs 40A, 40B are adapted to be placed within the apertures 24A,24B when the headset of the present invention is used without spectacles.

Referring again to FIG. 1, when the headset 12 is utilized, the user first positions the ear cups 14,20 over the ears as shown. The user then inserts the temples 32, of the spectacles 30 into the spectacle temple accommodating openings 24 and behind his or her ears. The spectacle temple accommodating openings 24 of the present invention substantially prevent the ear cups 14,20 from being pushed outward when the headset 12 is used with the spectacles 30. This maintains the effectiveness of the headset 12 by keeping the ear cups 14,20 positioned over the user's ears. Further, because the ear cups 14,20 are not pushed outward, a concentrated load is not placed on the ear cups 14,20 and temples 32,34. This prevents these parts from deforming causing excessive wear and further prevents the temples 32 from digging into the user's face 26.

Figure 3:
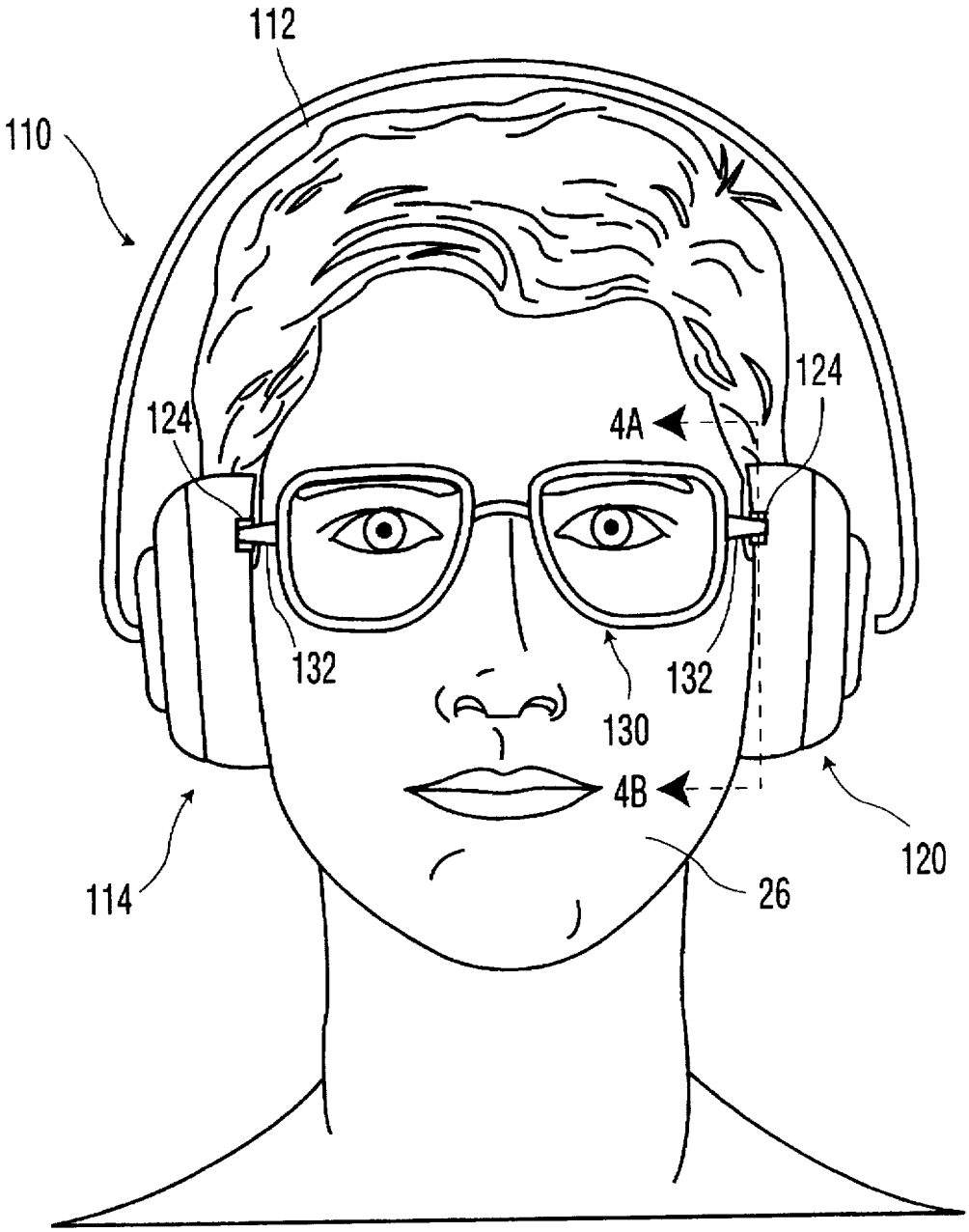
FIG. 3 is a front view of another embodiment of the headset with spectacle temple accommodating openings secured to the head of a user.

Referring to FIG. 3, a second embodiment of a headset 110 with spectacle temple accommodating openings is shown. The second embodiment of the present invention essentially functions in the same way as the first embodiment except the ear cups 114,120 do not have padded inserts. Thus, in this embodiment the ear cups 114,120 are adapted to surround the ears of the user 26.

In this embodiment, the inner surfaces of the ear cups 114,120, each have a notch 124 for the opening, which receive the temples 132 of the spectacles 130. The notches 124 enable a user to first put a pair of spectacles 130 on before the headset 110. After putting on the spectacles 130, the headset 112 is then placed on the user's head 26, positioning the ear cups 114,120 over the user's ear, so that a pair of temples 132 received within the notches 124.

Figure 4A:
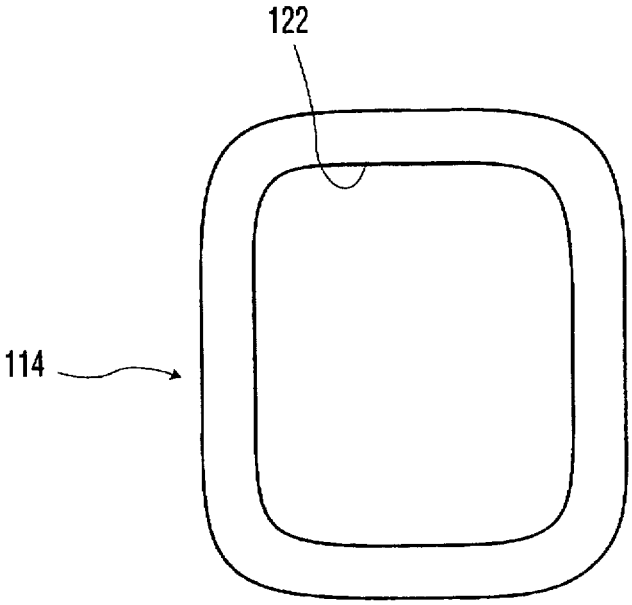
FIG. 4A is an inner view of one of the ear cups shown in FIG. 3.

Referring to FIG. 4A, there is shown an inner view of the ear cup 114. The ear cup 114 has a concave inner surface 122 that conforms the ear cup 114 to completely enclose a user's ears.

Figure 4B:
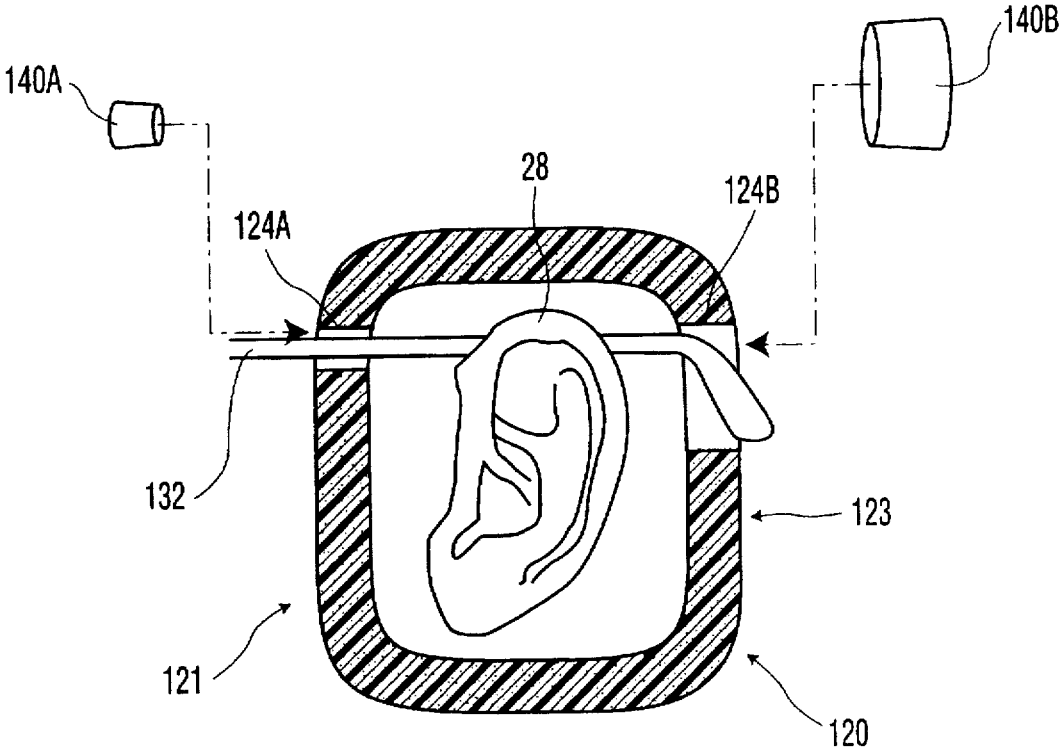
FIG. 4B is a cross-sectional view of one of the ear cups shown in FIG. 3 along line 4B.

Referring to FIG. 4B, there is shown a cross sectional view of the ear cup 120. The notch 124 includes a first notch 124A that extends substantially horizontal through a front portion 121 of the ear cup 120 and a second notch 124B that extends substantially horizontal through a rear portion 123 of the ear cup 120. The notches 124A,124B should be positioned within the ear cup 120 so that the temple 132 will remain in place when the ear cup 120 is positioned over the ear 28 as shown. The second notch 124B is substantially wider than the first notch 124A, which enables the second notch 124B to receive the curved portion of the temple 34.

It should be understood that apertures can be used alternatively in place of the notches 124A,124B shown and described above. This embodiment also includes a pair of sound blocking plugs 140A, 140B. The sound blocking plugs 140A, 140B are adapted to be placed within the notches 124A, 124B when the headset of the present invention is used without spectacles.

While the invention has been particularly shown and described with reference to preferred embodiments thereof, it will be understood by those skilled in the art that changes in form and details may be made therein without departing from the spirit and scope of the present invention.

What is claimed:

1. A headset device comprising a pair of ear cups;

a head strap for coupling the ear cups; for providing a bias for maintaining the ear cups positioned over an ear of a user; and for isolating the user's ear from the external sound environment; and temple accommodating means associated with each of the ear cups for receiving a spectacle temple and for securing the spectacles to the head of the user, wherein the temple accommodating means includes a first opening in a front portion of the ear cup and a second opening in a rear portion of the ear cup; and wherein the second opening is larger than the first opening for receiving the curved end portion of a spectacle temple, such that the temple accommodating means supports the spectacles, thereby enabling the user to wear a pair of spectacles along with the headset device.

2. The device of claim 1, wherein each said ear cup includes audio means for providing sound to the user's ear.

3. The device of claim 1, wherein said first opening and said second opening provide a substantially horizontal passage for each of the temples of the spectacles.

4. The device of claim 1, wherein both said first opening and said second opening are apertures.

5. The device of claim 1, wherein said first opening and said second opening are notches.

6. The device of claim 1, wherein each said ear cup includes a substantially rigid portion and a padded portion.

7. The device of claim 6, wherein said temple accommodating means is contained within said substantially rigid portion.

8. The device of claim 6, wherein said temple accommodating means is contained within said padded portion.

9. An ear cup device for headsets that are adapted to be worn by a user wearing spectacles having a pair of temples, comprising:

the ear cup adapted to enclose an ear of the user; and temple accommodating means disposed on the ear cup for receiving one of the temples such that the ear cup supports the spectacles and secures the spectacles to the head of the user;

wherein the temple accommodating means includes a first opening in a front portion of the ear cup and a second opening in a rear portion of the ear cup; and wherein the second opening is larger than the first opening for receiving the curved end portion of a spectacle temple; and wherein there is a substantially horizontal passage disposed between the first opening and the second opening and in the upper one-half portion of the ear cup for receiving and supporting the spectacle temple over the user's ear so that the ear, together with the temple accommodating means, secures the spectacles to the user's head.

10. The device of claim 9, which further comprises audio means for providing sound to the user's ear.

11. The device of claim 9, wherein both said first opening and said second opening are apertures.

12. The device of claim 9, wherein said first opening and said second opening are notches.

13. The device of claim 9, wherein said ear cup includes a substantially rigid portion and a padded portion.

14. The device of claim 13, wherein said temple accommodating means is contained within said substantially rigid portion.

15. The device of claim 13, wherein said temple accommodating means is contained within said padded portion.

16. A headset device of the type having a pair of ear cups coupled together by a head strap providing a bias for maintaining the ear cups positioned over an ear of a user, the headset device further comprising:

temple accommodating means associated with each of the ear cups for receiving and supporting a spectacle temple, each temple accommodating means including a first opening in a front portion of each of the ear cups and a second opening in a rear portion of each of the ear cups, thereby enabling the user to secure a pair of spectacles to his or her head while wearing a pair of spectacles along with the headset device; and a first plug removably contained within the first opening and a second plug removably contained within the second opening for blocking sound when the user uses the headset device without the pair of spectacles.

* * * * *